US005193801A

United States Patent [19]

Coombs et al.

[11] Patent Number: 5,193,801

[45] Date of Patent: Mar. 16, 1993

[54] VARIABLE SPEED DRIVE FOR SORTER TRAY SHIFTING CAMS

[75] Inventors: Peter M. Coombs, Tustin; Richard S. Howell, Jr., Rancho Santa Margarita, both of Calif.

[73] Assignee: Gradco (Japan) Ltd., Tokyo, Japan

[21] Appl. No.: 779,557

[22] Filed: Oct. 18, 1991

[51] Int. Cl.[5] ..... B65H 39/10

[52] U.S. Cl. ..... 271/293; 271/294

[58] Field of Search ..... 271/292, 293, 294

[56] References Cited

U.S. PATENT DOCUMENTS

| | | | |
|---|---|---|---|
| 3,802,694 | 4/1974 | Post et al. | 271/294 X |
| 4,433,837 | 2/1984 | Romanewski | 271/294 X |
| 5,042,793 | 8/1991 | Miyake | 271/293 X |

*Primary Examiner*—Robert P. Olszewski
*Assistant Examiner*—Carol Lynn Druzbick
*Attorney, Agent, or Firm*—Newton H. Lee, Jr.

[57] ABSTRACT

A moving bin sheet sorter has rotatable cams which engage portions of the sorter trays to move the trays at the ends adjacent to a sheet entry location between positions at which those tray ends are closely spaced above and below the sheet entry location and further spaced apart at the sheet entry location for receiving sheets supplied from a copier or printer. The cams are driven by an electric motor which is controlled to operate at a low speed as the trays are initially engaged and disengaged from the cam and a high speed during the major movement of the trays, thereby reducing noise resulting from high speed impact and shock loading of the cams and cooperative portions of the trays, as well as reducing noise resulting from high speed impact of said cooperative portions of the trays in guides for the trays.

8 Claims, 4 Drawing Sheets

Fig. 1
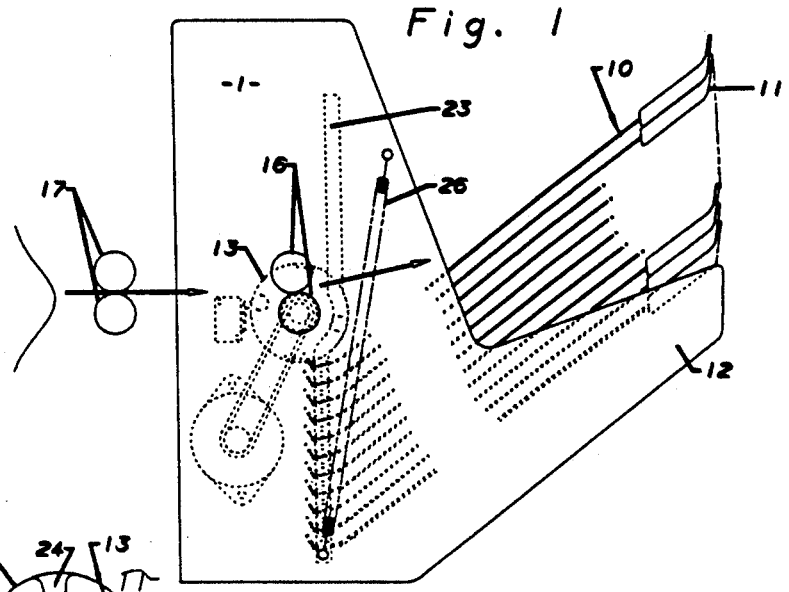
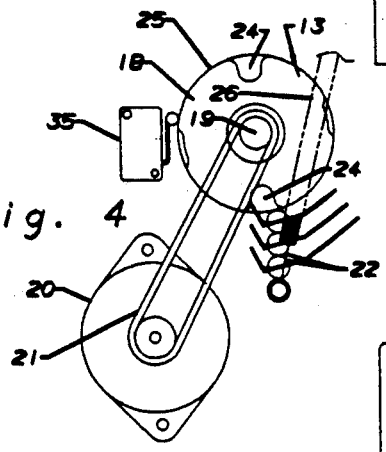
Fig. 4
Fig. 2
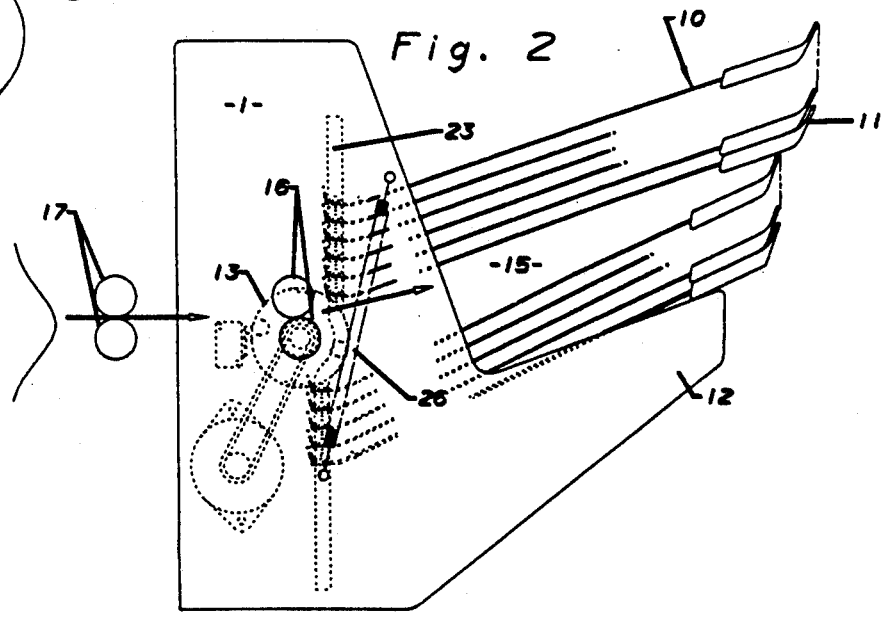

VARIABLE SPEED DRIVE FOR SORTER TRAY SHIFTING CAMS

BACKGROUND OF THE INVENTION

Moving bin sheet collators or sorters for use with office copiers and printers have evolved in which a set of receiver trays are supported for movement relative to a sheet entry location, at which sheets enter the sorter from a copier or printer, so that the trays are close together at positions above and below the sheet entry location but are widely spaced apart at the sheet entry location to facilitate entry of the sheets into a bin.

Examples of such sorters are illustrated in the prior patents of Lawrence, U.S. Pat. No. 4,343,463 granted Aug. 10, 1982; DuBois and Hamma, U.S. Pat. No. 4,328,963 granted May 11, 1982; and DuBois, U.S. Pat. No. 4,478,406 granted Oct. 23, 1984, as well as in Hamma application Ser. No. 06,483,596, filed Apr. 11, 1983, owned commonly herewith.

Such sorters utilize cams to engage cam follower portions of the trays to move the ends of the tray adjacent to the sheet entry location between the closely spaced positions above and below the cams which define the enlarged space between the trays at the sheet entry location. The cams are driven in opposite directions by a drive motor under control of suitable means to cause operation of the motor as required to collate a desired number of sets of sheets having a desired number of sheets per set. The motor control means may be self-contained in the sorter or the control means may be incorporated, as well, in the host copier.

In any event the motor is caused to be driven in opposite directions and intermittently depending upon the sorting task to be performed, so that the sorting is bidirectional, i.e., the trays move up and down during sorting operations to receive sheets supplied from the copier or printer.

Each revolution, or partial revolution, of the cams, depending on the profile of the cam and the motor controlling means, causes the cams to move from a stationary dwell position to an active position to move the trays. Activation of the cams, in many forms, will inherently cause initial impact with the cam followers before the followers commence to move the trays. This impact causes objectionable noise which is increased when the cam follower portions of the trays are spring biased in one direction into contact with the cams to cause the cams to engage the follower portions of the trays and/or when the cam must move at a high rate of speed.

In the case where the cam follower portions of the trays directly abut when the trays are in their closely spaced positions above and below the cams, the noise problem can be alleviated, to some extent by segregating the follower portion and the tray spacing portions of the tray, particularly in the case of utilization of certain cam forms like the helical form of Lawrence U.S. Pat. No. 4,343,463 or DuBois U.S. Pat. No. 4,478,406.

However, in the case of cam wheels of the type referred to in DuBois and Hamma U.S. Pat. No. 4,328,963 and the Hamma application Ser. No. 483,596, as "Geneva" wheels having one or more radial openings formed in the periphery of a rotary mechanism, the noise problem is severe, in part due to the fact that such sorters typically employ a spring to load the trays located below the cams upwardly for engagement with the cams.

The magnitude of the noise is a function of a) the speed of travel of the cam when the follower on the tray engages in the radial notch or is disengaged from the notch by engagement with a wall defining a guide slot for the follower and b) the load on the follower caused by springs and/or the weight of the trays, including paper therein. Accordingly the problem is exacerbated in the higher speed sorters in which the cams must be rapidly moved to shift the trays during a relatively short period of time between copies.

SUMMARY OF THE INVENTION

The present invention relates to reducing the noise problems of the types described above.

A major advantage of such noise reduction relates to the fact that not only is the noise level objectionable to the user and others in an office environment, but also noise level limits on office equipment are subject to increasingly stringent regulation by various authorities in different market areas, such that, certain sorters of the class here involved may not be capable of operation at acceptable noise levels.

The present invention contemplates minimizing the noise caused by impact of the cam followers on the trays with the cam followers with cam follower guides and impact and shock loading of the cam followers with one another as the cams are rotated from a dwell position into a tray shifting position, in either direction, by rotating the cams at relatively low speed at the time of transition between dwell and raising or lowering of the trays, compared with the relatively high speed at which the cams are rotated to raise or lower the trays following engagement with the cam followers.

More particularly, the invention provides for varying the speed of the cam drive motor by changing the duty cycle of the power supplied to the electric drive motor and sensing the position of the cam followers with respect to the cams, so that from the normal or stationary dwell positions of the cam until following transition from the dwell positions to active positions at which the followers are being shifted to move the trays, the motor drives the cam at a relatively low speed and then at a higher speed until just prior to completion of the shifting movement, but thereafter again at the low speed as the cam followers return to the dwell position.

The manner in which noise is minimized will be better understood by reference to the accompanying drawings in light of the following description of a preferred form of the invention.

BRIEF DESCRIPTION OF THE DRAWINGS

FIG. 1 is a side elevation illustrating one form of sorting machine to which the subject matter of the invention is applied, showing the movable sorter trays in a non-sort condition;

FIG. 2 is a view corresponding with FIG. 1, but showing the trays in one sorting position.

FIG. 4 is an enlarged fragmentary detail view of the tray shifting means at one side of the apparatus, as taken on the lines 4—4 of FIG. 3;

DETAILED DESCRIPTION

Figure 3:
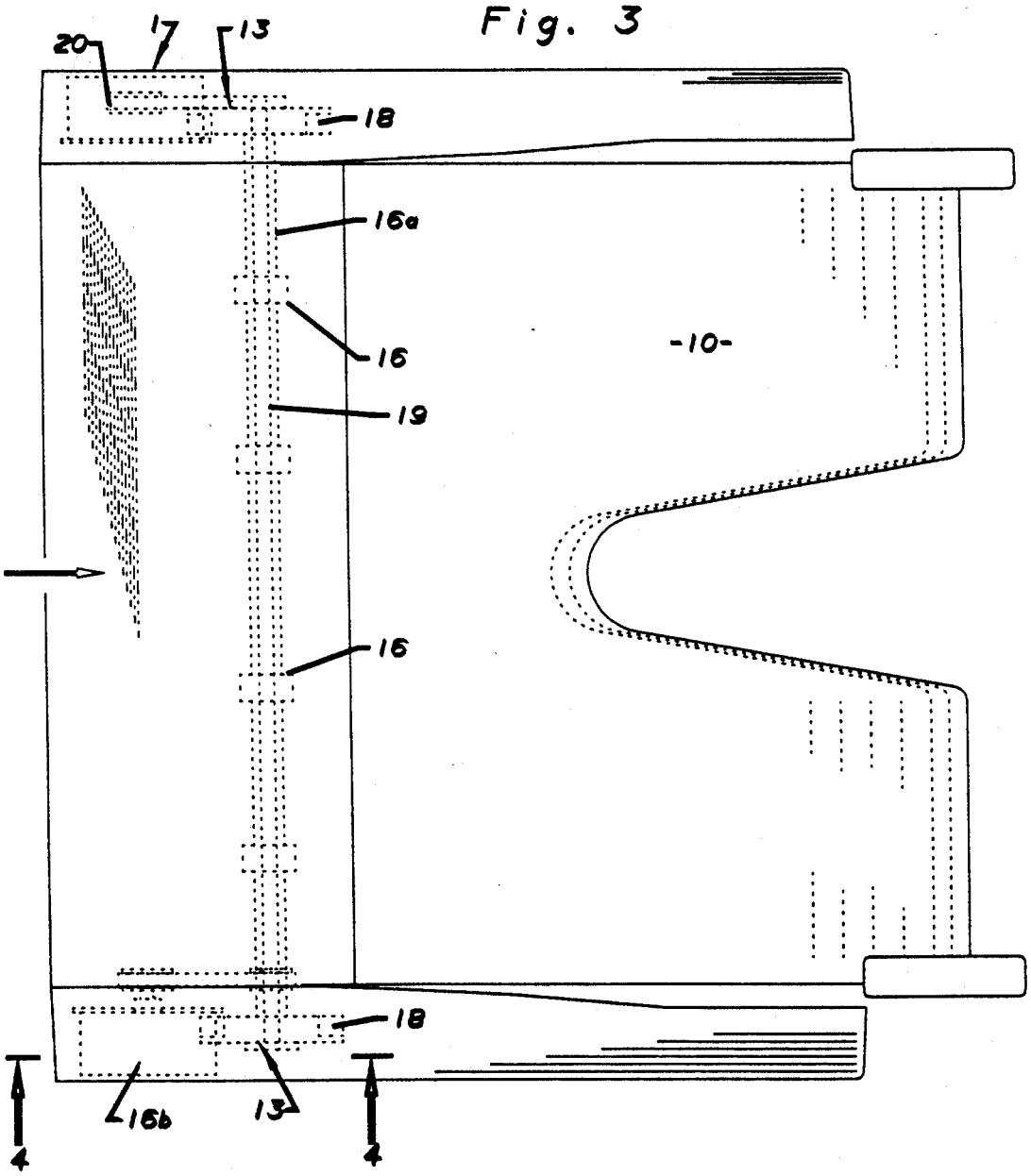
FIG. 3 is a top plan view of the sorter.

As seen in the drawings, referring first to FIGS. 1–3 one form of sorting machine is generally illustrated. Such a form of sorter is illustrated and described in greater detail in the above referred to U.S. Pat. No. 4,328,963.

The sorting machine comprises, in the form shown, a frame structure 1 which supports a set of sheet receiving trays 10. At their outer ends 11, which extend from the frame structure, the set of trays is supported on a base support 12 provided by the frame structure, the individual trays 10 having their outer ends 11 supported for pivotal movement one on the other and enabling the inner ends of the trays to be shifted vertically by tray transfer or shifting means 13 in succession and intermittently between positions at which the inner ends of all of the trays are disposed below the shifting means 13, as shown in FIG. 1, to positions at which the inner ends of the trays successively are positioned above the shifting means 13, as shown in FIG. 2.

During such shifting movement of the trays, an enlarged sheet entry space 15 is provided between trays into which sheets of paper are fed, in the form shown, by sheet transport rolls 16, as the sheets are supplied from the exit rolls 17 of a copying machine or printer adapted to supply copies of a page or sheet of a document to the sorter for collation of successive copies or to receive individual documents. The apparatus thus may function as a collator in conjunction with a copier or as a receiver or mailbox in conjunction with a printer. As is well known, such sorters are operable under the control of suitable systems which, following the feeding of a sheet into one tray, causes the transfer means to shift the tray vertically either to the upper tray position or the lower tray position defining the sheet receiving space 15 to facilitate entry of the sheet, while the trays are closely nested together at all other positions.

The transfer means 13, in the illustrated form, as best seen in FIGS. 3 and 4, includes a tray transfer wheel 18 at each side of the frame structure mounted on a horizontally extended shaft 19 to be rotated together in opposite directions by a drive motor 20 and belt or chain 21 at one side of the frame structure. The feed rolls 16, as seen in FIG. 3 are on a balloon counter shaft **16*a* driven by a sheet feed motor 16*b***.

At the inner ends, or the sheet receiving ends adjacent to the sheet entry location of the feed rolls 16, the trays are adapted to be engaged by the transfer wheels 18 so as to be vertically shifted. Accordingly, the inner ends of the trays have cam followers in the form of trunnions or rollers 22 extending laterally at opposite sides of the trays through vertically extended guide slots 23 in the frame structure so as to be engaged by the transfer wheels 18, whereby upon rotation of the transfer wheels in either direction the tray ends will be shifted vertically.

To engage the trays, the transfer wheels are provided with one or more radial notches or recesses. In the illustrative embodiment there are two notches 24 on opposite sides of the center of the wheel which are formed to receive the cam followers or trunnions 22 on the trays. Thus, each semi-revolution of the transfer wheels will cause the cams to engage the follower of a first tray in a notch and move the tray end upwardly or downwardly, depending upon the sense or rotation of the cams, to form between adjacent trays the enlarged space 15.

In the case of the sorter herein illustrated, gravity causes the trays above the transfer wheels to rest on the circular periphery 25 of the wheels and to engage in the slots 24. On the other hand, a suitable bias is provided to cause the trays below the cams to engage the circular periphery 25 and move into the notches 24 when the transfer wheels are rotated. As shown, coiled tension springs 26, only one of which is shown, are connected at opposite sides of the assembly to the lowermost tray, at its inner end, and to the frame structure at a location above the transfer wheels to load the trays upwardly into engagement with the transfer wheels. The spring 26, therefore, must be rated to lift the cumulative weight of the trays, plus the weight of the sheets of paper in the trays.

At this point, it will now be recognized that when the trays are being moved downwardly, the weight of the trays and paper above the transfer wheels forcing the followers 22 into the cam notches 24 will cause an impact of the followers entering the notches and shock loading of all of the super-jacent followers. Also, as the followers 22 at the low side of the transfer wheels are being displaced into the downwardly extending slot 23, and depending upon the speed of movement of the transfer wheels, there is an impact of the cam followers being discharged with the next followers below in the slot, as well as with the side wall of the slot, coupled with shock loading of the sub-jacent cam followers, downward movement of which is resisted by the upward bias of spring 26.

The same impact problem and shock loading exists when the trays are being pivoted upwardly by the transfer wheels or cams. However, the cause of the problem differs because, in this case, the spring causes impact and shock loading of the cam followers below the transfer wheel as the top followers below the wheel are forced into the cam notches, while the over-burden of the trays, and paper therein, above the transfer wheels resists upward movement of the upper trays, coupled with impact of the followers being discharged from the cam notches against the side wall of the upwardly extending guide slot.

All of this impact and shock loading of trunnions in the usual sorters of the type here involved results in a noise level which is objectionable, particularly in the case of use of the sorter with more modern and quieter copiers and printers and even more particularly where regulation places stringent limits on the noise level accompanying operation of office equipment.

In this type of sorter, while the merger of the circular periphery or dwell portion 25 of the cam with the side wall of the notches may be arched to reduce the abruptness of the change, i.e., smooth out the transition between the dwell and the tray moving action of the cam, or for that matter between the dwell and active faces of other cam forms, there is a practical limit to such efforts to reduce impact and shock loading and resultant noise.

Therefore, the present invention has as its salient feature control of the cam speed as the cam follower engages with and disengages from the active portion of the cam so as to reduce the momentum of the impact and shock loading and, thus, the resultant noise, e while also after engagement with an dis-engagement of the upper and lower tray ends, driving the cam at a sufficiently higher rate of speed to complete tray transfer during the available time before the sorter is to receive another sheet.

This concept will be better understood with reference to FIGS. 5*a*–5*f*.

Figure 5A:
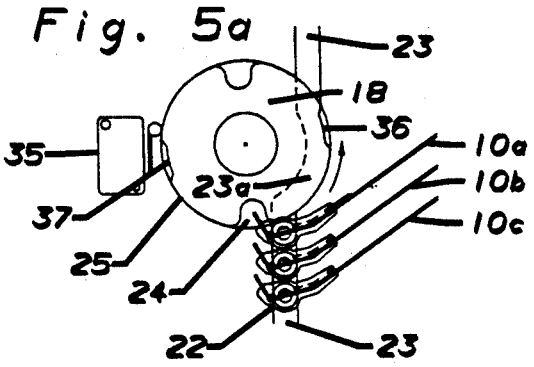
FIG. 5*a* is a fragmentary detail view showing the bin shifting cam of FIG. 4 in a position with the trays in the non-sorting condition of FIG. 1.

As seen in FIG. 5*a*, tray 10*a* represents the uppermost tray of the set of trays below the cam and the cam follower 22 of tray 10*a* is on the dwell or circular periphery 25 of the cam or transfer wheel 18 at a location adjacent to one of the radial recesses or slots 24, while the cam followers of trays above the cam during continued sheet sorting operations as seen in FIG. 2 would be located in the guide slot 23 and rest on the circular dwell portion 25. At this time the cam 18 remains stationary until the drive motor is activated to rotate the cam in a counterclockwise direction. Under the conditions that the cam is stationary any output of sheets from the host copier or printer will be received in the tray 10*a*.

Figure 5B:
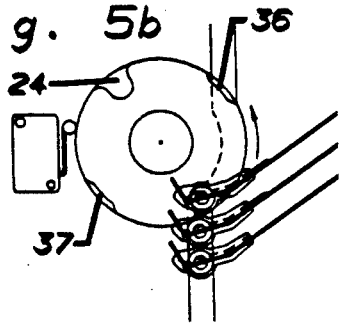
FIG. 5*b* is a view corresponding with FIG. 5*a* showing the cam rotated to engage a cam follower portion of the top tray.
Figure 5C:
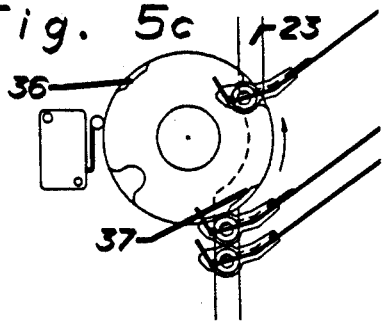
FIG. 5*c* is a view showing the tray shifting cam as it moves the top tray upwardly at a high speed to increase the sheet receiving space.
Figure 5D:
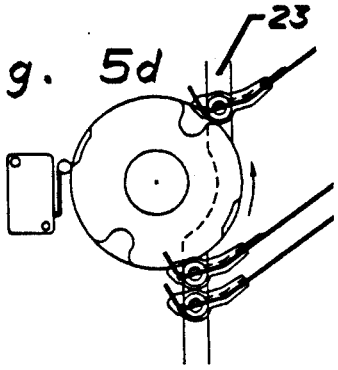
FIG. 5*d* is a view showing the tray shifting cam as it discharges the top tray at low speed.
Figure 5E:
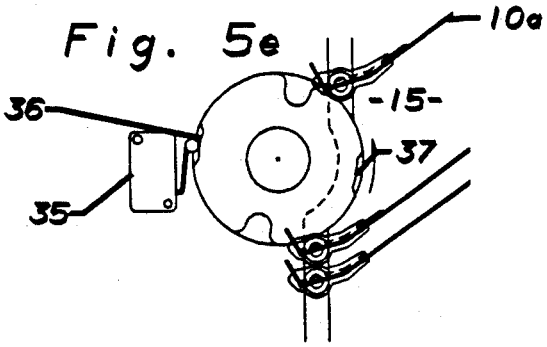
FIG. 5*e* is a view showing the tray shifting cam in transition from the point of discharge of the top tray to the point of stopping prior to lifting the next sub-jacent tray.
Figure 5F:
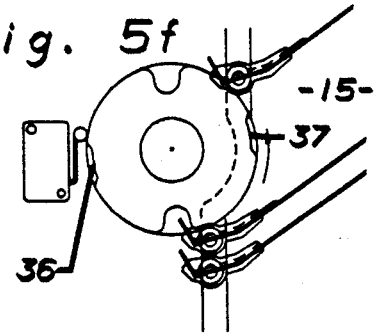
FIG. 5*f* corresponds with FIG. 5*a*, showing the cam stopped in position to engage the next sub-jacent tray.

During the sorting operations of the sorting machine the trays are to be moved in sequence upwardly at the ends 10*a*, 10*b*, 10*c*, et seq., not shown, to ultimately provide the enlarged sheet receiving space 15 (seen in FIG. 5*f*). If will be understood from the description above that upward movement of the tray ends into engagement with the cam is caused by the strong bias of the spring 26 which must lift the weight of the entire tray set together with any paper previously received in the trays during sorting operations. The cam 18 is caused to rotate in a counterclockwise direction, in half revolution increments, as seen by the arrow in FIGS. 5*b*–5*e* to cause upward movement of the trays, as the upper trunnion is engaged in the notch 24 and carried upwardly until discharged from the notch, as the follower 22 is caused to move in and follow the upwardly extending guide slot 23 while displacing upwardly the subadjacent cam followers. The period of energization of the drive motor is controlled, by a one-half revolution switch 35, but if only one notch 24 is provided the motor is energized for the period of a full revolution, under the control of variable speed control means later to be described.

The motor speed control means just referred to causes the cam to rotate to the position of FIG. 5*b* at low speed, so that the impact of the follower 22 with the base of the notch 24 and the impact of the trailing face of the notch 24 with follower 22 is also at low speed, resulting in less noise from impact and shock loading of all the sub-jacent cam followers as they are urged forcefully upwardly by spring 26.

In FIG. 5*c* the cam and follower are in a state at which the cam has been moved at high speed or full speed of the motor through the arched section 23*a* of the guide slot to proximity with the upwardly extending guide slot 23. The motor operates at reduced speed momentarily as impact occurs between the follower 22 and the confronting vertical edge of slot 23, and with the cam follower next above which must be lifted, as the follower is displaced from the notch 24.

Thereafter from the condition of FIG. 5*d*, the cam is driven again at high speed through the position of FIG. 5*e* to return to the position of FIG. 5*f*, the same cam position as FIG. 5*a*, but with tray 10*a* elevated and held in position above tray 10*b* to provide enlarged sheet entry space 15 between trays 10*a* and 10*b*.

These operations are repeated successively with each one-half revolution of the cam, under the control of the usual sorting control selector which determines in such sorters the number of trays to be shifted depending upon the number of sets of documents being collated or collected in the case of a printer which supplies collated sets.

Figure 6:
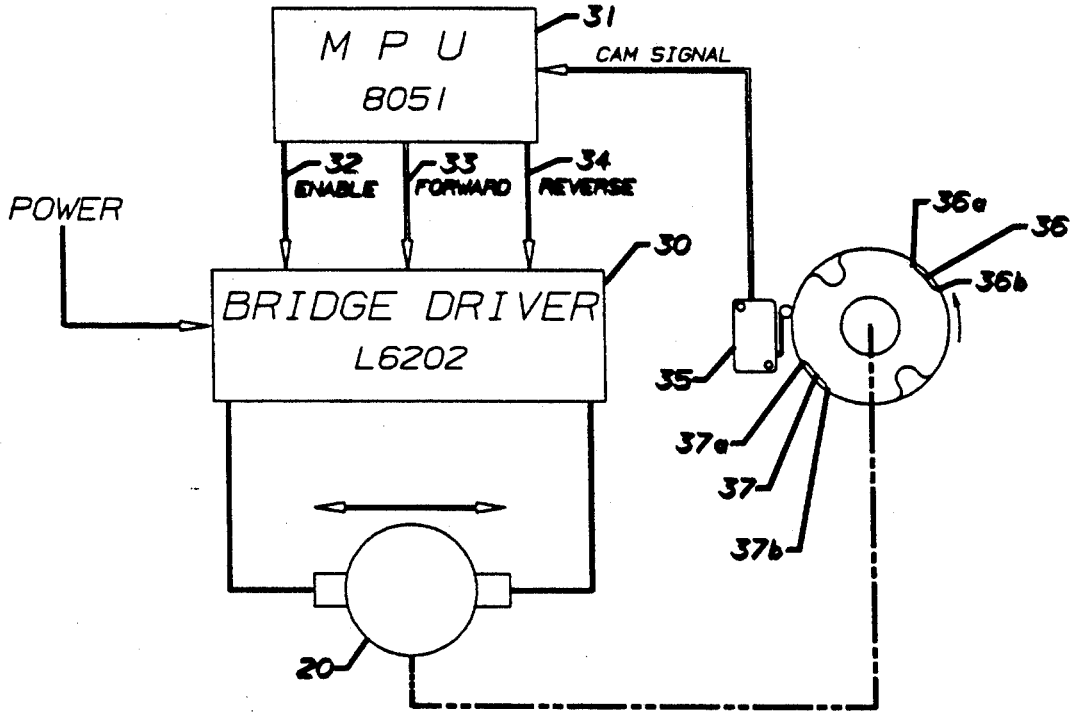
FIG. 6 is a diagram of the preferred drive motor control system.

Motor 20 which drives the cams 18 is preferably a direct current motor the power to which is controlled so as to cause the low speed and high speed operation. As shown in FIG. 6, a motor bridge drive 30 is controlled by a microcontroller 31 programmed to provide power to a motor enable input 32 and to motor forward and motor reverse inputs 33 and 34, respectively.

Microcontroller 31 also receives motor control signals from micro switch 35 which is operated by one of the bin shifting cams 18. The switch arm, as seen in FIGS. 5*a*–5*f* rides on the outer periphery of the cam 18 in a normally off condition. The cam 18 has a pair of substantially diametrically spaced low cam regions 36 and 37 providing circumferentially spaced leading edges 36*a* and 37*a* and trailing edges 37*a* and 37*b*, respectively. Low cam 36 is operable during rotation of the cam in a counterclockwise direction, as illustrated in FIGS. 5*a*–5*f*, and low cam 37 is operative during clockwise rotation of the cam, to cause signals to the motor to stop the motor and cam at a position for engagement with the next cam follower during the next cycle of operation, as will be described below.

Microprocessor 31 is programmed so that for slow speed operation, power is supplied to the motor in a short series of pulses; while during high speed operation the motor is fully energized for a longer period of time, then de-energized to cause deceleration, and then pulses are resumed to cause low speed rotation for a brief period before the motor is energized for high speed operation to a point where the motor is briefly energized in the opposite direction to cause it to stop.

Figure 7:
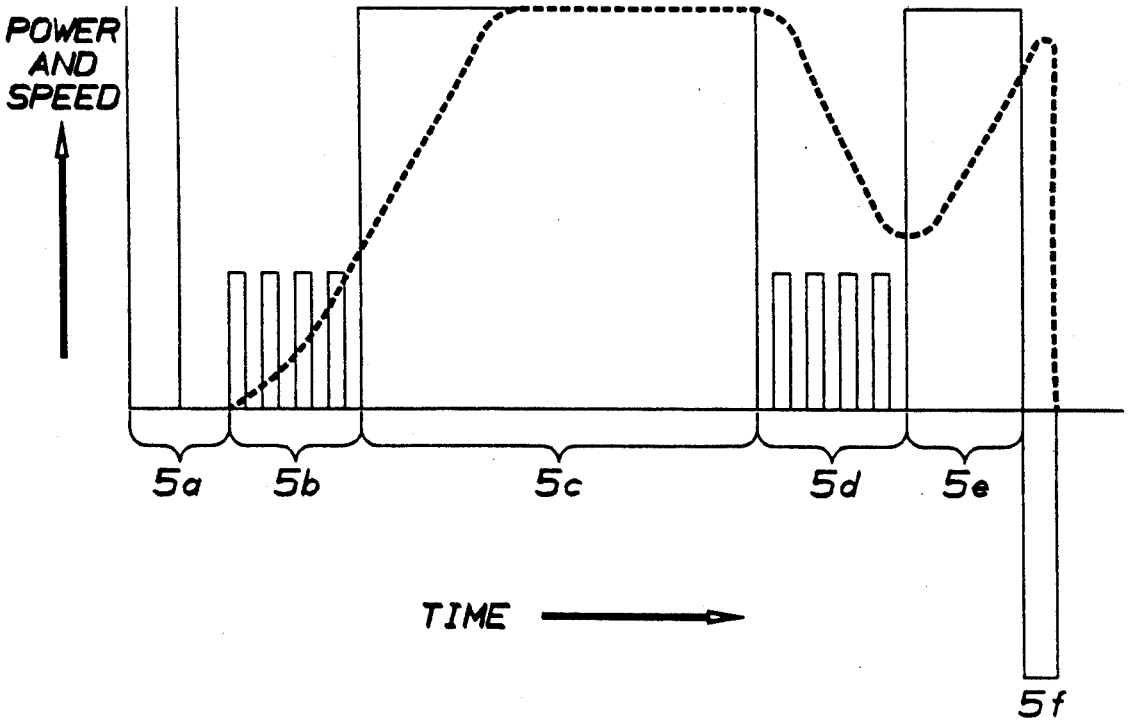
FIG. 7 is a graph showing the preferred speed curve of the drive motor compared with the variation in the duty cycle of the applied motor power.

This periodic, or pulse width modulation energization of the motor is shown by a full line in FIG. 7 and the approximate resultant acceleration-deceleration curve for the motor is shown by the broken line representing one-half revolution of the cams. If the cam had only a single notch, then the high speed mode would be applied through an additional 180 degrees of rotation of the cam.

From the foregoing and with reference to FIG. 7, it will be understood that the sequence of operation as seen in FIGS. 5*a*–5*f* and described above is as follows:

The normal position of the cam when it is at rest but ready to commence a cycle of operation to shift a tray, say tray 10*a* in FIG. 5*a*, is seen in FIG. 7 in the bracketed section 5*a* of the power and speed versus time graph at which power is off. Then, as seen by the bracketed time period designated 5b in FIG. 7, power is applied to the motor for a short period of time in a series of pulses sufficient to initiate revolution of the cam and rotate it through an angle necessary to engage the follower 22 on tray 10a in the notch 24, as seen in FIG. 5b. At this time continuous power is supplied to the motor over a period of time sufficient to cause the motor to accelerate to the high speed level as indicated by the bracketed time period FIG. 5c in FIG. 7. As the cam follower in the cam notch approaches the upwardly extending guide slot 23, as seen in FIG. 5d, the motor is again energized only by a series of pulses illustrated by the bracketed time line designated FIG. 5d in FIG. 7, so that as the follower impacts with the upwardly extending side wall of the guide slot 23, as well as with the follower already disposed in the guide slot 23, the motor and cam decelerated to the low speed mode thus reduces the noise caused by input and shock loading. Thereafter, for a brief period represented by the bracketed time line of FIG. 7 designated FIG. 5e, uninterrupted power is again supplied to the motor causing it to again accelerate to move the cam towards a position at which it will engage and commence upward movement of the tray 10b. At this point, in order to stop the motor the low cam portion 36 of the cam is in a position relative to the switch 35 that the micro switch has signaled to the controller 31 as a result of passing over the cam section 36a that it will receive a motor stop signal. The motor stop signal is given when the micro switch is actuated by the low cam section 36b, and at this time, for a brief moment, micro processor 31 causes the energization through connector 34 of the motor 20 in a reverse direction which causes the motor to abruptly stop as indicated by the portion of the time line of FIG. 7 designated FIG. 5f, showing the negative application of power.

During upward movement of the trays successively, the above operation is repeated, pausing only so long as necessary for a new copy sheet to be fed through the sorter to the enlarged sheet receiving space 15. It will be understood that the interval between actuation of the tray shifting means is keyed to the interval between the feeding of such sheets, and, therefore, the total time period during which the successive trays must be shifted and the relationship between high and low speed operation is keyed through the micro processor 31 to the interval between the feeding of sheets. Thus the relationship between high and low speed transitional movement can be adjusted to accommodate sorters of different speeds and cams with one or more notched 24 or other profiles.

It will also be recognized that the noise problem encountered in such sorters is more acute in machines operating with a brief inter-copy interval and that the ability of the present invention to reduce noise by low speed operation of the sorter at the critical points of contact between the cam and the follower and between the follower and the side wall of the slots and other followers is particularly advantageous in the sorters operating at higher speeds.

In the preferred form herein shown and described the specific control means for the motor involves the use of pulse modulated power application for low speed operation, since heat generation is minimized. However, other ways, such as the use of variable resistors and/or capacitors are extant or controlling electric motor speeds, but such other means are more difficult to adjust or tune to the specific needs of sorters of the type here involved.

We claim:

1. In a sheet sorter of the moving tray type comprising: a frame structure, a plurality of trays supported by said frame structure to receive successive sheets from a sheet infeed location, tray shifting cam means including a rotating cam and follower means on said tray ends for moving ends of said trays at said sheet infeed location between closely spaced positions above and below the rotary shifting cam and spacing said ends apart to provide an enlarged sheet receiving space between adjacent tray ends located above and below the rotary cam, a reversible electric motor for driving said rotary cam, and means for controlling said motor, the improvement wherein said means for controlling said motor drives said motor selectively at a low speed and a high speed whereby said motor is driven at said low speed to effect engagement of said rotary cam with said follower means to initiate movement of said ends of said trays and at said high speed to move said ends of said trays to enlarge the space therebetween and to stop said motor when said adjacent trays are located by said cam to provide said enlarged space.

2. A sheet sorter as defined in claim 1, wherein said means for controlling said motor also causes said motor to be driven at said low speed when said tray ends are near the end of their movement between said positions.

3. A sheet sorter as defined in claim 2, wherein following movement of said follower means said means for controlling said motor causes said motor to be driven at said high speed to position said rotary cam for engagement with the next follower means before causing said motor to stop.

4. A sheet sorter as defined in claim 1, wherein said rotary cam is circular and has a peripheral notch for receiving said cam follower means and including spring means biasing said ends of said trays in an upward direction to cause engagement of said cam follower means with said circular wheel and in said notch upon rotation of said wheel at said low speed.

5. A sheet sorter as defined in claim 1, wherein said rotary cam is circular and has a peripheral notch for receiving said cam follower means and including spring means biasing said ends of said trays in an upward direction to cause engagement of said cam follower means with said circular wheel and in said notch upon rotation of said wheel at said low speed, and said frame structure has vertically extended guide slots in which said cam follower means are guided into and from engagement with said wheel and said notch.

6. A sheet sorter as defined in claim 1, wherein said rotary cam is circular and has a peripheral notch for receiving said cam follower means and including spring means biasing said ends of said trays in an upward direction to cause engagement of said cam follower means with said circular wheel and in said notch upon rotation of said wheel at said low speed, and said frame structure has vertically extended guide slots in which said cam follower means are guided into and from engagement with said wheel and said notch by said guide slots, and said means for controlling said motor causes wheel to be driven at said slow speed in either direction during engagement of said cam follower means in said notch and dis-engagement of said cam follower means from said notch and movement of said cam follower means into said guide slot.

7. A sheet sorter as defined in claim 1, wherein said motor is a DC motor and said means for controlling said motor causes said motor to run at said low speed by applying selected modulated power pulses to said motor and at high speed by applying uninterrupted power to said motor.

8. A sheet sorter as defined in claim 1, wherein said means for controlling said motor includes a section on said cam and a switch operable by said section on said cam whereby said motor stops said cam in a position for engagement with successive cam follower means upon the succeeding energization of said motor.

* * * * *